United States Patent [19]

Yelf

[11] Patent Number: 4,471,889

[45] Date of Patent: Sep. 18, 1984

[54] VALVED LIQUID DISPENSER AND HOLSTER

[75] Inventor: Jack T. Yelf, British Columbia, Canada

[73] Assignee: MacMillan Bloedel Limited, Vancouver, Canada

[21] Appl. No.: 445,704

[22] Filed: Dec. 1, 1982

[51] Int. Cl.[3] ..... B67D 5/64

[52] U.S. Cl. ..... 222/175; 222/179.5; 222/212; 222/505; 222/511; 224/245; 239/152; 239/586

[58] Field of Search ..... 222/175, 179.5, 212, 222/469, 511, 173; 224/242, 245; 239/152, 327, 239/586; 248/311.3

[56] References Cited

U.S. PATENT DOCUMENTS

| | | | |
|---|---|---|---|
| 2,017,319 | 10/1935 | McMullen | 248/311.1 |
| 2,294,594 | 9/1942 | Bloomfield | 222/469 |
| 2,753,094 | 7/1956 | Haney . | |
| 2,927,717 | 3/1960 | McDermott | 222/213 |
| 3,451,597 | 6/1969 | Watson | 222/212 |
| 3,631,994 | 1/1972 | Mackzum . | |
| 4,138,044 | 2/1979 | Musgrave . | |
| 4,327,845 | 5/1982 | Keyes et al. | 222/469 X |

FOREIGN PATENT DOCUMENTS 893003 2/1972 Canada .

*Primary Examiner*—Joseph J. Rolla
*Assistant Examiner*—Frederick R. Handren
*Attorney, Agent, or Firm*—Banner, Birch, McKie & Beckett

[57] ABSTRACT

A liquid dispenser is disclosed for application of herbicides and the like. The dispenser overcomes problems of applying herbicides because it avoids liquid spilling on an operator and provides a controlled application to a specific area. The dispenser includes in combination a dispenser for discharging liquid and a holster for holding the dispenser. The dispenser comprises a squeezable liquid container having a connection to a valved nozzle portion, the valve nozzle portion having a valve to open and close a liquid passage to at least one nozzle, the valve having a pivoted operating arm extending up along side the container, a spring adapted to pivot the arm from adjacent the container, providing a closed position for the valve, to a position away from the container providing an open position for the valve, and the holster adapted to hold the dispenser with the nozzle at the bottom thereof, the valved nozzle portion covered, and the operating arm adjacent the container with the valve in the closed position, the holster having structure for attachment to an operator.

6 Claims, 4 Drawing Figures

VALVED LIQUID DISPENSER AND HOLSTER

The present invention relates to a liquid dispenser. More specifically the present invention relates to a combination of a dispenser for discharging a liquid, and a holster for holding the dispenser. The dispenser has a valve which is automatically closed when the dispenser is held in the holster and is opened ready for discharging a liquid when the dispenser is free of the holster.

There is a requirement in the forest industries for applying herbicide to reforested areas to encourage the growth of timber crop. The application of herbicide, however, is considered environmentally unacceptable because the chemicals used for herbicide treatments present high environmental problems. Many herbicides contain dioxins and others produce dioxins while biodegrading after application. These chemicals can lead to contamination not only of the user but also of the environment in which the herbicides are applied.

Forest safety committees have decided that crews should not handle these herbicide chemicals until safe equipment is available that avoids operator contamination, and permits controlled application to the trees. In the past the type of equipment used for herbicide application has been designed primarily for other purposes such as fire extinguishers, agriculture sprayers, paint marking guns, squeezable bottles with various attachments, etc. None of them have proved acceptable primarily because of the problem of leakage from these applicators and the lack of control in applying the liquid to the timber crop.

It is a requirement of the present invention to provide a dispenser for discharging a liquid which can be held in one hand so that an operator can accurately control the quantity of liquid dispensed, the dispenser can be fitted in a holster attached to an operator with the nozzle pointing downwards so that no liquid leaks down the sides of the dispenser. In as much as herbicide chemicals are hazardous, liquids should not be carried in a back pack with tubes or connecting pipes in view of possible leakage. Furthermore in the application of a herbicide it is preferred that the liquid be applied in a jet or solid stream to minimize contamination by vaporization and evaporation.

Whereas the dispenser of the present invention has primarily been designed for use as a herbicide applicator using chemicals which may be hazardous to the health, it is also possible to use the dispenser with expensive chemical liquids such as fungicides and hormonal treatment compositions. Such liquids are applied in commercial market gardening for flowers, vegetables and fruits as well as the forest industries. The dispenser has a valve which closes when the unit is held in the holster thus wastage of the liquid is avoided. The dispenser of this invention does not meter a particular flow of liquid, so quantity of liquid applied is controlled by the operator. The type of discharge from the dispenser is a jet or solid stream for a herbicide, however for other liquids a different nozzle may be installed which produces a liquid spray.

The present invention provides in combination, a dispenser for discharging a liquid, and a holster for holding the dispenser. The holster can be attached to an operators clothing such as by a belt loop or the like and holds the dispenser with the nozzle at the bottom. The dispenser can easily be handled in one hand and has an operating lever which closes a valve to prevent liquid being dispensed from the nozzle of the dispenser, the operating lever always closing the valve when the dispenser is in the holster but having a spring release to automatically open the valve when the dispenser is free of the holster. The operator can always close the valve by pressing the operating lever. A squeeze bottle, forming the liquid container, allows an operator to meter a certain quantity of the liquid where required when the valve is open.

The present invention provides in combination, a dispenser for discharging a liquid, and a holster for holding the dispenser, the dispenser comprising a squeezable liquid container having connection means to a valved nozzle portion, the valved nozzle portion having a valve to open and close a liquid passage to at least one nozzle, the valve having pivoted operating arm extending up along side the container, a spring means adapted to pivot the arm from adjacent the container, provided a closed position for the valve, to a position away from the container, providing an open position for the valve, and the holster adapted to hold the dispenser with the nozzle at the bottom thereof, the valved nozzle portion covered, and the operating arm adjacent the container with the valve in the closed position, the holster having attachment means for attachment to an operator.

In further embodiments of the invention, the dispenser is a squeezable plastic bottle having a threaded connection to the valved nozzle portion. The valved nozzle portion feeds to two jet nozzles adapted to produce two solid streams of liquid. The attachment means on the holster is preferably a belt loop which can be connected to an operator in the field.

In yet a further embodiment a seal means is provided on the valved nozzle portion of the dispenser to seal with the holster when the dispenser is in the holster adapted to prevent any liquid in the holster escaping if the holster is tipped up. In yet a further embodiment the valve comprises a cylindrical member slidingly fitted in a cylindrical hole in the valved nozzle portion, the spring means comprising a coil spring located in the cylindrical hole pushing against the cylindrical member to open the valve, and the pivoted operating arm being connected to the cylindrical member by a pin and key hole arrangement to ensure pivoting of the operating arm moves the cylindrical member.

In drawings which illustrate embodiments of the invention,

Figure 1:
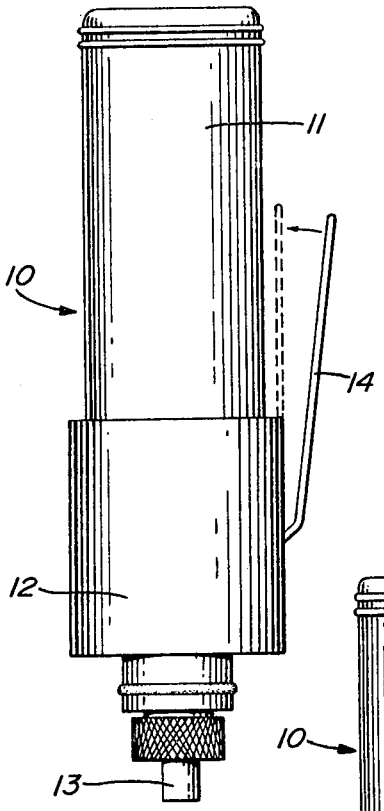
FIG. 1 is a side elevation of a dispenser according to one embodiment of the present invention.

Referring now to the drawings, FIG. 1 shows a dispenser 10 having a squeezable liquid container 11, preferably a plastic bottle, fitted into a valved nozzle portion 12 having a nozzle 13 at the base thereof and a pivoted operating arm 14 at the side. The operating arm 14 is shown positioned away from the side of the container 11 so that valve is open. This valve position allows the container 11 to be squeezed, and liquid is discharged from the nozzle 13.

Figure 2:
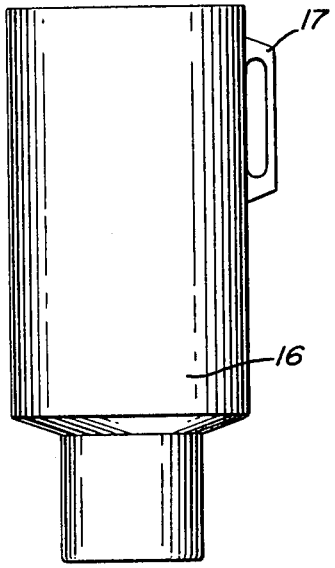
FIG. 2 is a side elevation of a holster for holding the dispenser shown in FIG. 1.
Figure 3:
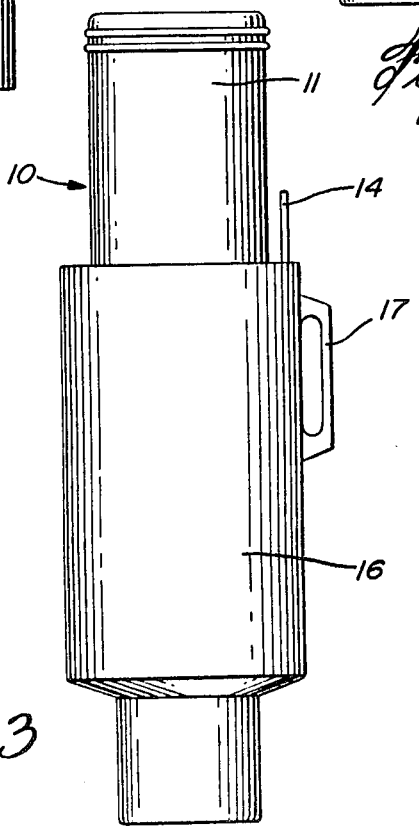
FIG. 3 is a side elevation showing the dispenser of FIG. 1 held in the holder of FIG. 2.

The holster 16 shown in FIG. 2 is preferably formed of a one piece molded plastic to hold the dispenser 10 so that the nozzle 13 of the dispenser 10 is at the bottom. The dispenser 10 is a snug fit in the holster 16 so that it does not fall out if the holster is tipped. A belt loop 17 is shown for attaching the holster 16 to the belt of an operator. In practice it is preferred that the holster 16 be positioned at the side or behind the operator rather than at the front. However each operator may determine the preferred location for positioning the holster on a belt. FIG. 3 shows a combination of the dispenser 10 fitted in the holster 16. When the dispenser 10 is inserted into the holster 16 the pivoted operating arm 14 is pushed onwards to a position beside the container 11 which closes the valve so no liquid can be discharged from the nozzle 13.

Figure 4:
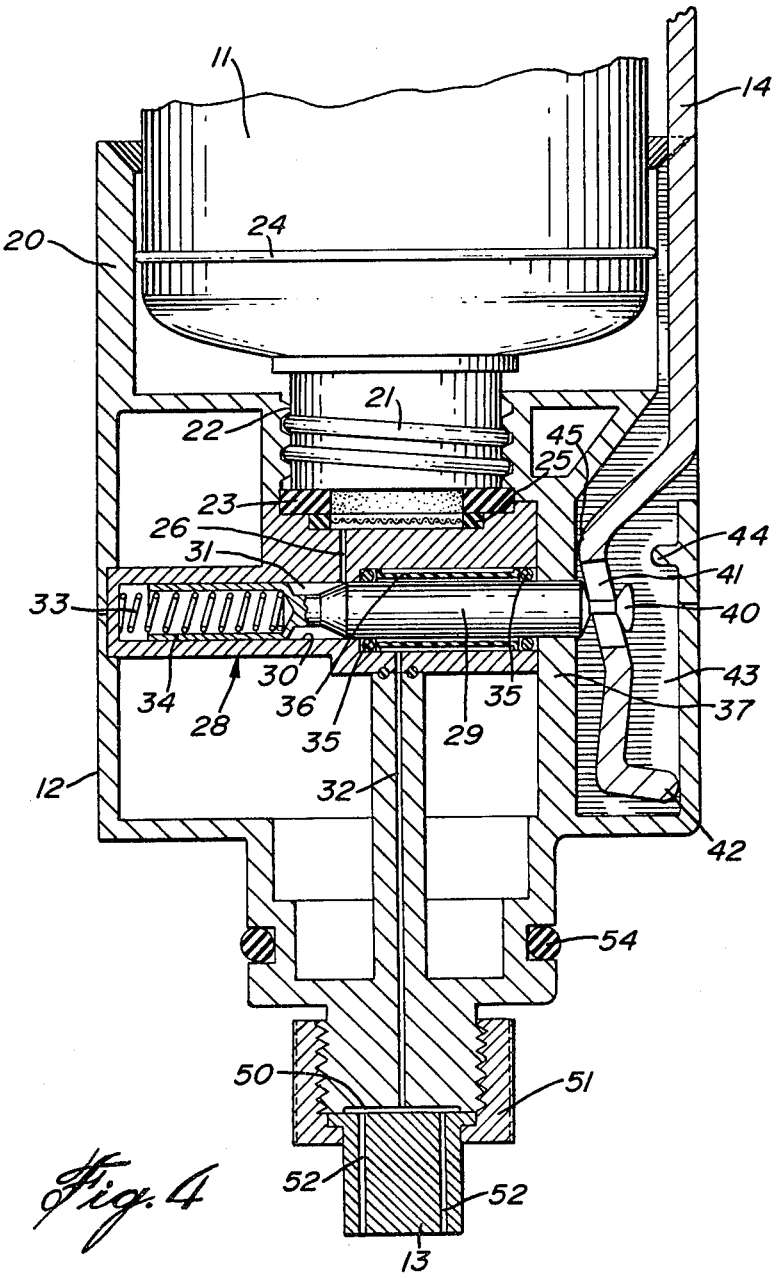
FIG. 4 is a partial sectional elevation showing the valved nozzle portion of a dispenser according to one embodiment of the present invention.

Details of the valved nozzle portion 12 are illustrated in FIG. 4. The valve system disclosed here is in common use in pneumatic and hydraulic equipment. A top guide sleeve 20 guides a positions the squeezable container 11 so that threaded portion 21 of the container 11 screws into the threaded hole 22 in the valved nozzle portion 12 and has a seal ring 23 at the base thereof to prevent leakage from the container 11. The container 11 has a circular rib 24 about the clyindrical surface which slides into the guide sleeve 20 of the valved nozzle portion 12 forming a snug fit and preventing movement between the container 11 and the sleeve 20. A screen washer 25 is located beneath the threaded portion 21 of the container 11 to prevent solid particles in the container 11 entering the valve nozzle 13. A first liquid passage 26 feeds from one side beneath the screen washer 25 to the valve mechanism 28 which includes a cylindrical member 29 to slide backwards and forwards in a cylindrical hole 30. The cylindrical member 29 has a reduced diameter area 31 to provide a passage for liquid to pass from the first liquid passage 26 to a second liquid passage 32 feeding to the nozzle 13. The second liquid passage 32 is located in the approximate center of the valved nozzle portion 12 whereas the first liquid passage 26 is eccentrically located. Thus in order for the liquid to pass to the nozzle it is necessary for the reduced diameter area 31 to span across these two passages 26, 32. A coiled spring 33 is positioned at the end of the cylindrical hole 30 and retained by a cup 34 at the end of the cylindrical member 29, the spring 33 pushes against the cylindrical member 29. Two o-ring seals 35 and a spacer 36 are provided to prevent liquid passing between the first liquid passage 26 and the second liquid passage 32 when the valve is closed, and from escaping through the cylindrical hole 30. The valved nozzle portion 12 is formed of three pieces, all preferably molded plastic, shoulders 37 on the two outside pieces hold the o-ring seals 35 and spacer 36 in place.

The pivoted operating arm 14 is connected to the cylindrical member 29 of the valve mechanism 28 by means of a tapered head extension pin 40 on the end of member 29 fitted in key slot 41 in the arm 14. The clearance between the pin 40 and the slot 41 is sufficient for the pivoted operating arm 14 to pivot, but still move the cylindrical member 29 in the cylindrical hole 30 when the arm 14 pivots. The pivoted operating arm 14 has a bent portion 42 at the end which rests in a slot 43 of the valved nozzle portion 12. A stop member 44 is provided in the stop 43 above the slot 41 in the arm 14 to provide a stop when the arm 14 is in the open position. A bent portion 45 on the arm 14 acts as a pivot point resting on the valved nozzle portion 12. The spring 33 pushes the cylindrical member 29 so that the arm 14 is pivoted outwards with its handle as far away from the container 11 as permitted. In this position the reduced diameter area 31 connects the two liquid passages 26 and 32 and when the squeezable liquid container 11 is squeezed, liquid flows to the nozzle 13. When the pivoted operating arm 14 is pushed in towards the container 11, the cylindrical member 29 slides in the cylindrical hole 30, the spring 33 is compressed and the reduced diameter area 31 is moved so that the two liquid passages are not connected, and the o-ring seal 35 prevents liquid passing through to the nozzle 13. The operating arm 14 is retained in this closed position when the dispenser 10 is held in the holster 16.

The second liquid passage 32 extends to an open space 50 where a nozzle 13 is attached by means of a knurled flange nut 51. The nozzle 13 shown in the figure has two apertures or jet nozzles 52 which permit two solid streams of liquid to be ejected. It will be apparent to these skilled in the art that this nozzle 13 can be replaced by one with a single jet or alternatively one with a spray arrangement if required.

A large o-ring seal 54 is provided on the lower portion of the valved nozzle portion 12 to mate with an inside cylindrical surface of the holster 16, thus when the dispenser is inserted in the holster 16, the o-ring seal 54 aids in holding the dispenser 10 in the holster 16 so that it does not fall out should it tip up if an operator falls or slips, and also prevents any liquid that may have drained from the second liquid passage 32 into the well of the holster 16 from spilling. The second liquid passage 32 is preferably as small as possible without permitting clogging to occur so that a minimum amount of liquid drains from these passages 32 when the valve 28 is closed.

The holster 16 is preferably made of a durable lightweight plastic, molded in one piece. As previously stated the container is a squeezable plastic bottle for preference and the valved nozzle portion 12 is also made of a suitable lightweight material sufficiently durable to stand up in field operations. In use, an operator holds the dispenser by the squeezable liquid container 11 with the nozzle 13 pointing in a downward direction, thus any liquid which drips from the nozzle falls on the ground. The operator must ensure the pivoted operating arm 14 is in the open position and the container 10 may then be squeezed to apply two solid streams of liquid to an appropriate location. The operator can control the flow of this liquid by merely varying the pressure on the container 11. Operators generally use only one hand for this operation, after discharging from the container 11, the operating arm 14 is closed to close the valve by squeezing it in to the container 11. The dispenser 10 is slid into the holster 16 with the nozzle 13 pointing in the downward direction. Thus liquid from the container does not get on the hands of the operator provided the nozzle 13 is always kept at the bottom of the dispenser 10. The operating arm closes the valve when the dispenser 10 is placed in the holster 16, and remains closed whilst in the holster 16.

Various changes may be made to the embodiment shown herein without departing from the scope of the present invention which is limited only by the following claims.

The embodiments of the invention in which exclusive property or privilege is claimed are defined as follows.

1. In combination, a dispenser for discharging a liquid, and a holster for holding the dispenser, the dispenser comprising a squeezable liquid container having connection means to a valved nozzle portion, the valved nozzle portion having a valve to open and close a liquid passage to at least one nozzle, the valve having a pivoted operating arm extending up along side the container, a spring means adapted to pivot the arm from adjacent the container, providing a closed position for the valve, to a position away from the container providing an open position for the valve, and the holster adapted to hold the dispenser with the nozzle at the bottom thereof, the valved nozzle portion covered, and the operating arm adjacent the container with the valve in the closed position, the holster having attachment means for attachment to an operator.

2. The combination according to claim 1 wherein the dispenser is a squeezable plastic bottle having a threaded connection to the valved nozzle portion.

3. The combination according to claim 1 wherein the liquid passage in the valved nozzle portion feeds to two jet nozzles adapted to produce two solid streams of liquid.

4. The combination according to claim 1 wherein the attachment means on the holster is a belt loop.

5. The combination according to claim 1 including a seal means provided on the valved nozzle portion of the dispenser to seal with the holster when the dispenser is in the holster adapted to prevent any liquid in the holster escaping if the holster is tipped up.

6. The combination according to claim 1 wherein the valve comprises a cylindrical member slidingly fitted in a cylindrical hole in the valved nozzle portion, the spring means comprising a coil spring located in the cylindrical hole pushing the against the cylindrical member to open the valve, and the pivoted operating arm being connected to the cylindrical member by a pin and key hole arrangement to ensure pivoting of the operating arm moves the cylindrical member.

* * * * *